US009532615B2

(12) United States Patent
Radefeldt

(10) Patent No.: US 9,532,615 B2
(45) Date of Patent: Jan. 3, 2017

(54) INSECT-REPELLING LEG GARMENT

(71) Applicant: Gregory Kain Radefeldt, Lindstrom, MN (US)

(72) Inventor: Gregory Kain Radefeldt, Lindstrom, MN (US)

( * ) Notice: Subject to any disclaimer, the term of this patent is extended or adjusted under 35 U.S.C. 154(b) by 839 days.

(21) Appl. No.: 13/887,145

(22) Filed: May 3, 2013

(65) Prior Publication Data

US 2013/0291275 A1 Nov. 7, 2013

Related U.S. Application Data

(60) Provisional application No. 61/687,964, filed on May 4, 2012.

(51) Int. Cl.
*A41D 13/00* (2006.01)
*A41D 13/06* (2006.01)
(Continued)

(52) U.S. Cl.
CPC ..... *A41D 13/0543* (2013.01); *A41D 13/001* (2013.01); *A41D 13/0575* (2013.01);
(Continued)

(58) Field of Classification Search
CPC A41D 13/0543; A41D 13/001; A41D 13/065; A41D 17/00; A41D 17/02; A41D 13/0575; A41D 3/06; Y10S 2/911; Y10S 2/919; A63B 71/1225; A63B 2071/125; A63B 2071/1258
(Continued)

(56) References Cited

U.S. PATENT DOCUMENTS 562,608 A 6/1896 Herbelin
1,537,845 A 5/1925 McElwee
(Continued)

FOREIGN PATENT DOCUMENTS

EP 1 598 475 B1 7/2009
GB 1034000 A * 6/1966 ..... A41D 17/02

OTHER PUBLICATIONS

UTEXBEL. BuzzX® Information Sheet. "How it Works". URL: http://www.buzzx.info/index.cfm?Id=2. Accessed Apr. 13, 2016. Via Google Search at http://www.google.com. Publication date: Apr. 18, 2009.*

*Primary Examiner* — Jameson Collier
(74) *Attorney, Agent, or Firm* — Michael A Mochinski

(57) ABSTRACT

An insect-repelling leg garment primarily configured with a tubular member and a semi-conical section fabricated from fabric sheeting impregnated with an insect-repelling solution. The semi-conical section includes an elastic strap configured to engage a structural feature of an article of clothing. The tubular member includes a lower portion having a first circumferential passage for accommodating therewithin a drawstring equipped with a drawstring tie for closing and sealing an annular opening formed by a circular wall section and one's leg. An elastic circular band positioned at the lower portion simultaneously engages loops connected to the lower portion and encircles around one's foot such as to oppose the upward tensioning caused by the elastic strap, whereby the insect repellency inherently present within the fabric sheeting and the structural barriers inherently present within the leg garment collectively serve to protect the lower extremities of one's body against biting insects.

20 Claims, 6 Drawing Sheets

(51) Int. Cl.
*A41D 13/05* (2006.01)
*A63B 71/12* (2006.01)
*A41D 17/02* (2006.01)

(52) U.S. Cl.
CPC ..... *A41D 13/065* (2013.01); *A41D 17/02* (2013.01); *A63B 71/1225* (2013.01)

(58) Field of Classification Search
USPC ..... 2/2.5, 4, 22–24, 51, 227, 242
See application file for complete search history.

(56) References Cited

U.S. PATENT DOCUMENTS 1,801,431 A 4/1931 Lown et al.
D108,928 S 3/1938 Behr
2,406,090 A 8/1946 Mas
2,411,922 A * 12/1946 Keohane ..... A41D 3/06 2/227
2,483,136 A 9/1949 Hamman et al.
2,720,040 A 10/1955 Rogers
3,191,185 A 6/1965 Martin
3,590,390 A 7/1971 Howard et al.
3,671,975 A * 6/1972 Vorsteher ..... A41D 1/082 2/232
3,930,090 A 12/1975 Campbell, Sr. et al.
4,023,223 A * 5/1977 Anderson ..... A41D 13/0125 2/79
4,115,906 A * 9/1978 Lavine ..... A41F 17/04 2/233
4,386,438 A * 6/1983 Evin ..... A41D 1/06 2/272
4,503,566 A 3/1985 Wheeler
4,633,527 A 1/1987 Ehring
RE32,506 E 9/1987 Hightower, Jr.
4,697,286 A 10/1987 Cho
4,825,475 A * 5/1989 Smart ..... A41F 17/02 2/312
4,920,577 A 5/1990 Scharf
4,987,613 A 1/1991 Loverdi et al.
5,005,215 A 4/1991 McIlquham
5,033,126 A 7/1991 Wruck et al.
D321,969 S 12/1991 Upthegrove, Jr. et al.
5,452,478 A 9/1995 Rombach et al.
5,570,470 A 11/1996 Miller
5,613,250 A 3/1997 Bell
5,815,948 A 10/1998 Dzielak
6,029,275 A 2/2000 DePrado
6,065,151 A 5/2000 Conine, III
6,141,802 A 11/2000 Drake
6,205,593 B1 3/2001 Schaub, Jr.
6,338,164 B1 1/2002 Howard
6,353,939 B1 3/2002 Arber
6,405,383 B2 6/2002 Heller et al.
6,654,962 B2 * 12/2003 DeMott ..... A41D 13/0581 2/22
6,665,875 B1 * 12/2003 Alonso ..... A41D 13/04 2/46
6,745,398 B1 * 6/2004 Hennessey ..... A41D 1/067 2/23
6,839,917 B1 1/2005 Landwehr
D575,027 S 8/2008 Williams
8,464,367 B1 * 6/2013 Mordecai ..... A43B 3/02 2/22
2003/0005505 A1 1/2003 DeMott
2005/0210564 A1 * 9/2005 Laitmon ..... A41D 17/02 2/227
2006/0048291 A1 * 3/2006 Sims ..... A41D 13/001 2/456
2006/0096008 A1 * 5/2006 Lin ..... A41D 3/06 2/242
2010/0005559 A1 1/2010 Majerfeld
2010/0313322 A1 * 12/2010 Sanchez ..... A41D 13/065 2/24
2011/0067159 A1 * 3/2011 Smith ..... A41D 1/08 2/22

* cited by examiner

INSECT-REPELLING LEG GARMENT

CROSS-REFERENCE TO RELATED APPLICATIONS

This application claims the benefit of U.S. provisional patent application No. 61/687,964, filed May 4, 2012, entitled "Insect-repelling Leg Garment," the disclosures of which, including all attached documents, are incorporated herein by reference in their entirety for all purposes.

FIELD OF THE INVENTION

The present invention relates in general to a leg garment suitable for wear on a person for repelling and preventing biting insects such as ticks and mosquitos from biting the lower extremities of one's body. Accordingly, the leg garment offers effective means for limiting one's exposure to diseases and illnesses generally associated with and often transmitted by a variety of insects.

BACKGROUND OF THE INVENTION

Biting insects are unquestionably present in many geographical regions of the United States as well as in various parts of the world. Biting insects have a strong evolutional drive to search for human or animal hosts to bite and consume blood for their nutritional needs or to supply nutrition to their eggs. The evolutional drive of these insects to consume blood is so strong that these insects can find humans and animals under extraordinarily difficult circumstances such that they will traverse great distances, climb long grass and weeds, and crawl through dense underbrush.

Insects such as the mosquito and tick, for example, are well known to sustain extraordinarily difficult circumstances to bite and consume the blood of humans. There are many species of insects that derive their identification and name based on the host they most commonly feed on, for example, the bird tick and the deer tick. Other biting insects may include biting flies and biting midges. Fleas are another biting insect that are equally bothersome to humans and pets. It is very difficult to avoid bites from these types of insects, as humans and animals will invariably encounter them upon entering their natural habitat.

Many people and animals that have been exposed to the varied types of biting insects described above may develop a skin reaction at the site or location where they are bitten. Typically, the skin reaction occurs as a result of the insects' desire to pierce the skin with their mouth to consume the blood. The bite itself, like any other surficial wound, may irritate the skin initially and, at a much later time, may become painful and very uncomfortable to the host human or animal. A common evolutionary trait generally associated with many biting insects is the development and production of anti blood coagulating compounds transferred to the host at the site of the bite prior to consuming the host's blood.

The fluid transfer from biting insects to a host is problematic in two ways. First, many people are allergic to the fluids and/or to the anti blood coagulating compounds biting insects inject. So in addition to the pain and discomfort of the insect bite, the lingering effects of an allergic reaction remain until the host body can neutralize the foreign anti blood coagulating compounds. A second more sinister problem of the fluid transfer from biting insects to humans and/or animals is the transmission of diseases and microorganism that they may carry within them. These diseases are quite harmful and can even be fatal to humans and animals. The presence of diseases or harmful microorganisms within any type of insect specie may have natural origins or have been transferred to them from an infected host.

A harmful and sometimes fatal form of disease generally associated with and transmitted by ticks is Lyme Disease. The blacklegged tick is the species believed to be the primary carrier. Lyme Disease is more common in the Northern Hemisphere, such as the Upper Midwest and Northeastern part of the Unites States. Lyme Disease is said to be transmitted by ticks to humans and deer from mice. Humans infected with Lyme Disease can suffer serious health issues ranging from very mild flu-like symptoms to very severe neurological disorders. Moreover, it has been studied and documented that ticks are responsible for carrying and transmitting the Powassan virus, which if contracted, can cause severe brain infection with possible fatal consequences. Accordingly, individuals exploring the outdoors need to exercise great care and caution to avoid being bitten by ticks and other disease carrying insects.

For these reasons, enjoyment of the outdoors can be greatly impaired by the presence of biting insects. Even simple outdoor activities in residential urban neighborhoods are not immune from biting insects. As urban developments expand farther and farther into undeveloped natural areas, human and pet exposure to biting insects is significantly increased. Also true, many residential developments and homeowners purposely create and maintain natural areas or environments for their admirable aesthetic pleasure. As such, gardening, lawn mowing and playing in the yard are now activities that increase the risk of exposure to disease from biting insects. For the true outdoorsman that engages in activities of hiking, camping and hunting, he/she will invariably encounter biting insects. Common and well known techniques to prevent or minimize the risk of exposure to biting insects include avoiding their habitat, limiting outdoor activity to hours when biting insects are less active, covering exposed skin with garments, or using naturally derived or manufactured chemical insect repellants.

As a first technique to reduce exposure to biting insects, one may take the requisite steps or precautions to avoid the habitat of biting insects, generally at the cost of enjoying the great outdoors. Many regions of the United States and other parts of the world experience the traditional four seasons with significant temperature changes: spring, summer, fall, and winter. Since winters can be long and harsh for some, there is a strong tendency or desire to get full enjoyment of the warmer weather that is generally offered only in the spring, summer, and fall. The warmer weather of these seasons makes them particularly suitable for one's participation in a wide variety of outdoor recreational activities. Many of these outdoor activities, both for fun or necessity, unavoidably place humans in a habitat of biting insects. It is not practical to completely avoid these areas without in many ways reducing the quality of life and participation of engaging in outdoor activities. Even if one took the great lengths necessary to totally avoid the outdoors, they could still be exposed to biting insects from a friend or family member that enters into a habitat of biting insects and unknowingly carries into their home or residence one or more biting insects.

As a second alternative technique of reducing exposure to biting insects, one may limit his or her participation in outdoor activities during times when biting insects tend to be in a less active state, such as when the sun is at its highest point in the sky to several hours thereafter, generally from the time of 12:00 p.m. to the early afternoon of 3:00-4:00 p.m. Coincidentally, this is a period of time when the daily temperature is at its hottest, but also a period of time when the majority of the population in the United States as well as elsewhere is actively working at their place of employment. Unavoidably for those preoccupied with their employment, activities associated with leisure outdoor recreation, lawn or garden maintenance, outdoor social gatherings, etc. will tend to occur during a period of time when biting insects become more active, primarily after sunset through the morning hours before noon.

As a third alternative technique of reducing exposure to biting insects, one may cover his/her exposed skin with one or more layers of clothing. Over time, however, many biting insects have perfected their capabilities to bite through clothing and/or crawl under clothing to undesirably feed on human hosts. Layered clothing may only provide minimal protection from insects, particularly those having the innate capacity to bite through clothing. The clothing must generally comprise a sufficient thickness in order to fulfill prevention of bites from biting insects. Although a proper, strategic arrangement of clothing may be effective in preventing bites from biting insects, the added clothing can greatly impede one's mobility and unduly compromise one's comfort during warm and hot weather conditions. Furthermore, the perspiration, heavy breathing, and release of additional body heat, odors and scents generated and developed while wearing additional clothing may invariably attract more biting insects to oneself, a situation that arises as having the opposite effect. The biting insect's innate capacity to seek out hosts for survival and to further reproduction stems primarily from their adaptive behaviors developed over a lengthened period of time. While layered clothing may offer limited, but not real practical, protection against biting insects, it does little to prevent insects from crawling under clothing. The bottom structural opening within in a pant leg, for example, provides a key access point for biting insects to crawl up within the interior space of the pant leg and traverse about the lower extremities of one's body, such as the surficial portions of the leg or ankle. Since many outdoor activities include constant motion through the habitat of biting insects, the pant leg is constantly opening to varying degrees to afford biting insects the many so ever opportunities to crawl under the pant leg and access the lower leg.

As a fourth and final alternative technique of reducing exposure to biting insects, one may use and apply on oneself one or more forms of insect repellants that are commercially available to the consumer. In general, insect repellants are most effective in preventing insect bites when applied directly to the skin and clothing. Insect repellants in the form of sprays and lotions are preferentially formulated for direct application to skin or clothing. The majority of chemical insect repellants commercially offered in today's markets may emit objectionable odors while on one's clothing for the duration of protection and, as such, the clothing must be thoroughly and sometimes repeatedly laundered to adequately rid the offending odor therefrom. Because of the undesirable nature of and the consumer's distaste for the odor, the insect repellant industry has taken an effort to reformulate select compounds present within the insect repellant product to mask or, more desirably, to eliminate the offending odor.

From a health perspective, however, application of chemical insect repellants, particularly aerosol or pump spray versions, must be done in a diligent manner to avoid contact with eyes, mouth, and nose to avoid irritation. A common chemical insect repellant DEET (N,N-Diethyl-meta-toluamide), also cautions users about ingestion, and risks and potential side effects of exposure and use. While extremely rare, DEET has been reported to cause minor skin irritations and in cases of heavy use, temporary hallucinations, weakness, agitation, and even a contributing factor in death.

Many chemical insect repellants must be reapplied from time-to-time in order to remain effective, as their effectiveness diminishes appreciably with perspiration, rain, and time. Chemical insect repellants must be applied evenly and completely to be effective. Areas of skin and clothing inadvertently missed at the time of application will be vulnerable to insect bites. Also, depending on the activity, it may not always be practical to reapply insect repellant. Applying chemical insect repellants to clothing must also be done with caution as some chemical repellants may damage or discolor sensitive garments.

Due to the possible side effects associated with chemical insect repellants, many have come to use natural insect repellants to guard against biting insects. While many find these as acceptable substitutes for chemical insect repellants, many argue that natural insect repellants are less effective or perhaps lack the concentration of key active compounds that make them most effective in terms of offering consummate protection. While natural insect repellants may not have many of the side effects of chemical insect repellants, they do share the same drawbacks: objectionable odors, effectiveness based on coverage, and requirements for repeated applications.

Both chemical and natural insect repellants can be applied to a user as described above or emitted from an object near the user. For example, burning citronella candles is a common practice for mitigating the presence of biting insects such as mosquitos within a defined area, but generally being used exclusively in outdoor environments; and for that reason, the use of citronella candles becomes less practical and less effective for outdoor activities taking place within large settings or areas such as those commonly associated with hunting or hiking. The market does offer more portable and wearable forms of citronella-emitting devices for localized use and protection, but their effectiveness may come into question in protecting other parts of one's body, such as around the foot and ankle areas.

Accordingly, there remains a need for a wearable leg garment that is particularly suited to protect the lower extremities of one's body, such as about the legs and ankle, from biting insects, most notably where insects are more likely to access and traverse and feed on the human host to further and satisfy their nutritional needs and requirements.

BRIEF SUMMARY OF THE INVENTION

In order to overcome the numerous drawbacks apparent in the prior art an insect-repelling leg garment has been devised for wear on a person, particularly being positioned about and worn on one's legs to offer protection against biting insects, such as ticks, mosquitos, fleas, mites, spiders, etc.

It is an object of the present invention to provide an insect-repelling leg garment that eliminates the need and requirement to use, apply and re-apply chemically or naturally based insect repellants on one's clothing that may adversely affect and alter the structure and appearance of worn clothing or on one's skin that may cause allergic reactions or other adverse skin conditions.

It is another object of the present invention to provide an insect-repelling leg garment that offers long-term and continuous, effective insect-repelling protection against biting insects despite repeated events of washing and laundering the garment.

It is another object of the present invention to provide an insect-repelling leg garment that offers compact storage on or apart from a person during non-use thereof.

It is another object of the present invention to provide an insect-repelling leg garment that minimizes air-borne exposure and inhalant risks to active compounds and ingredients generally present in and often associated with chemically based insect repellants of spray form.

It is another object of the present invention to provide an insect-repelling leg garment that reduces objectionable odors generally associated with consumer applied insect repellants.

It is yet another object of the present invention to provide an insect-repelling leg garment that furthers protection against biting insects by means of the strategic arrangement of physical barriers, particularly as such to supplement the insect-repelling capacity offered solely by the garment's fabric and material of construction.

It is yet another object of the present invention to provide an insect-repelling leg garment that is attractively pleasing, comfortable, compliments a variety of fashion styles, and cooperates with one's footwear and belt or belt loop to further its stationary positioning about the wearer during active conditions of use and wear thereof.

In accordance with the present invention an insect-repelling leg garment has been devised for wear on a person, substantially of which comprises a semi-conical section and a tubular member selectively formed by connecting first and second leading edges of a rectangular portion defined within a piece of fabric sheeting, the fabric sheeting being pretreated with an insect-repelling solution that sufficiently offers long-term protection notwithstanding repeated efforts to launder and wash the leg garment, the semi-conical section comprises an elastic strap configured to engage and encircle a structural feature of an article of clothing, such as one's belt or belt loop, the elastic strap comprising a first end fixedly connected to an upper converging end of the semi-conical section and a second end having a hook-and-loop fastener configured to engage and mate with a hook-and-loop fastener associated with an outward side of the fabric sheeting, the leg garment further comprising a lower portion configured with a first circumferential passage for receiving and accommodating therewithin a drawstring equipped with a drawstring tie at its ends for closing and opening an annular opening formed by a circular wall section and outer surficial portion of one's leg, the lower portion comprising an elastic circular band for simultaneously engaging first and second loops and a bottom portion of footwear such as to oppose the upward tensioning effect established by the elastic strap, the outward side of the fabric sheeting further comprising one or more storage pockets and a knee guard being positioned approximate the mid-section of the tubular member and comprising an inner compartment for receiving therewithin a foam pad, whereby the insect repellency inherently present within the fabric sheeting and the structural barriers inherently present within the leg garment collectively serve to protect the lower extremities of one's body against biting insects.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE INVENTION

While this invention is susceptible of being embodied in many different forms, the preferred embodiment of the invention is illustrated in the accompanying drawings and described in detail hereinafter with the understanding that the present disclosure purposefully exemplifies the principles of the present invention and is not intended to unduly limit the invention to the embodiments illustrated and presented herein. The present invention has particular utility as a leg garment for wear on a person such as to limit one or more insects from accessing the lower extremities of one's body and prevent thereabout bites from insects such as ticks and mosquitos that may carry viruses and transmit diseases to the human host.

Figure 1:
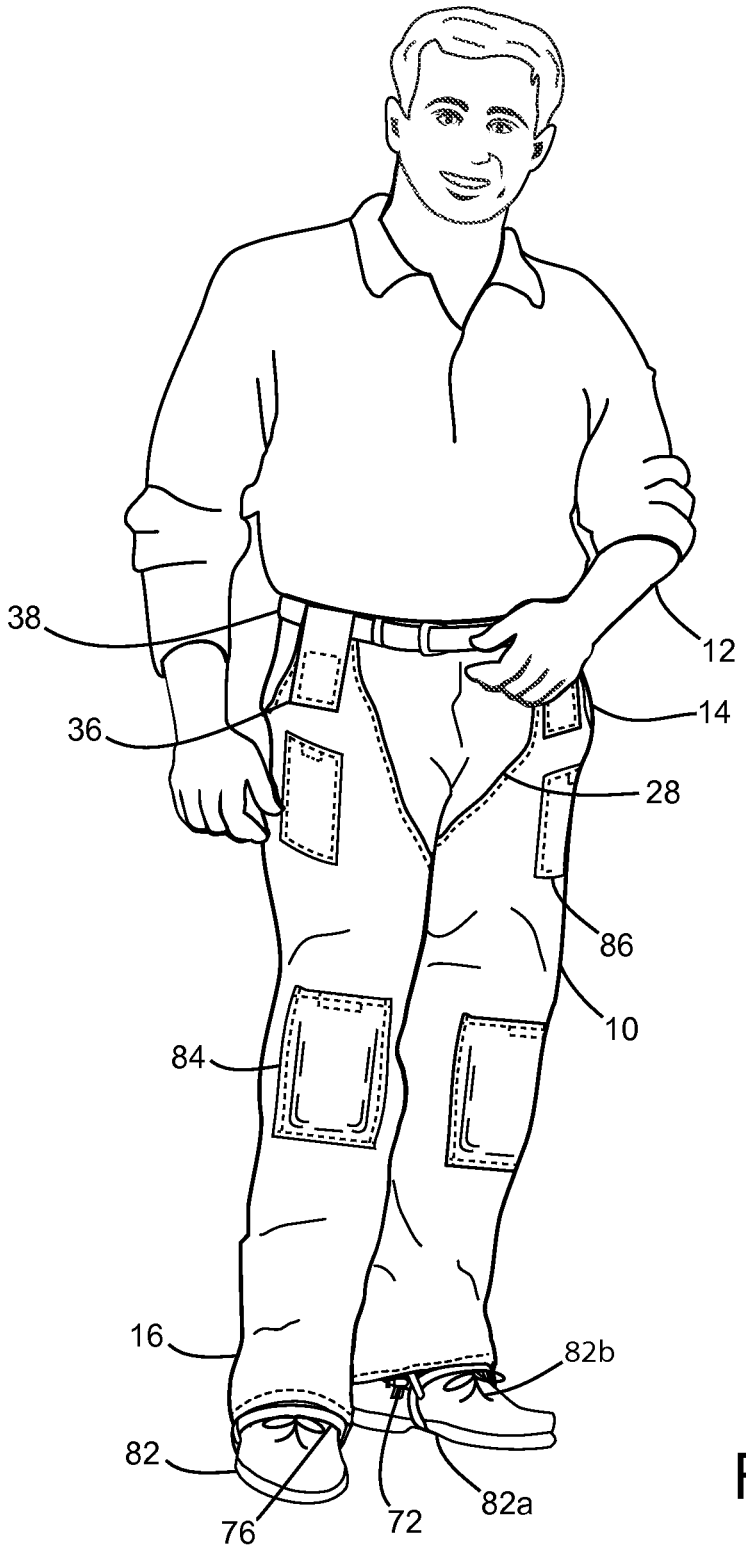
FIG. 1 is a perspective view of the preferred embodiment of the present invention illustrating its placement on a person.
Figure 2:
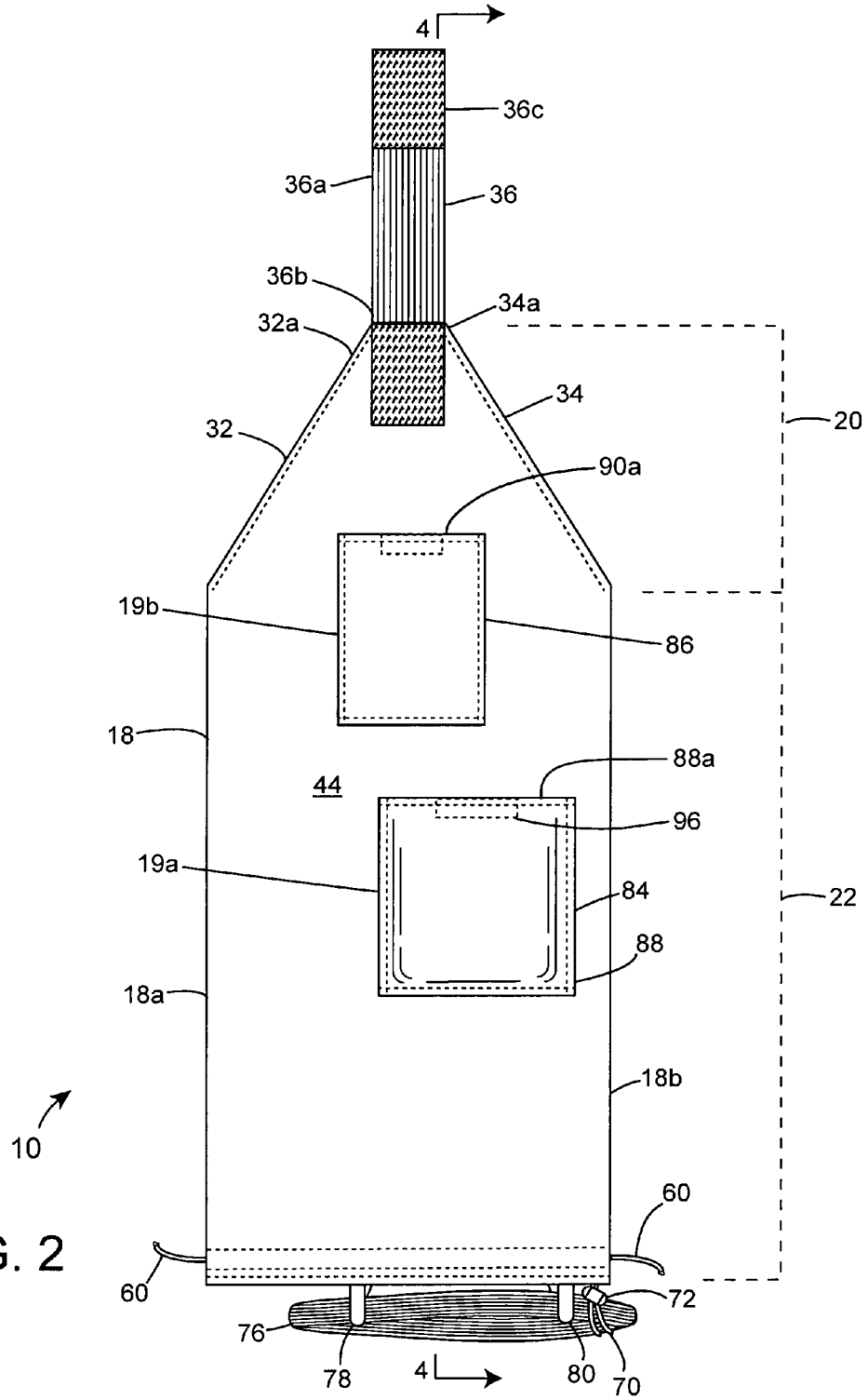
FIG. 2 is a front side view of the preferred embodiment of the present invention illustrating the geometric shape of a tubular member in an open, laid out form and comprising an elastic strap connected to an upper converging end thereof and an elastic circular band associated with a lower portion thereof.
Figure 3:
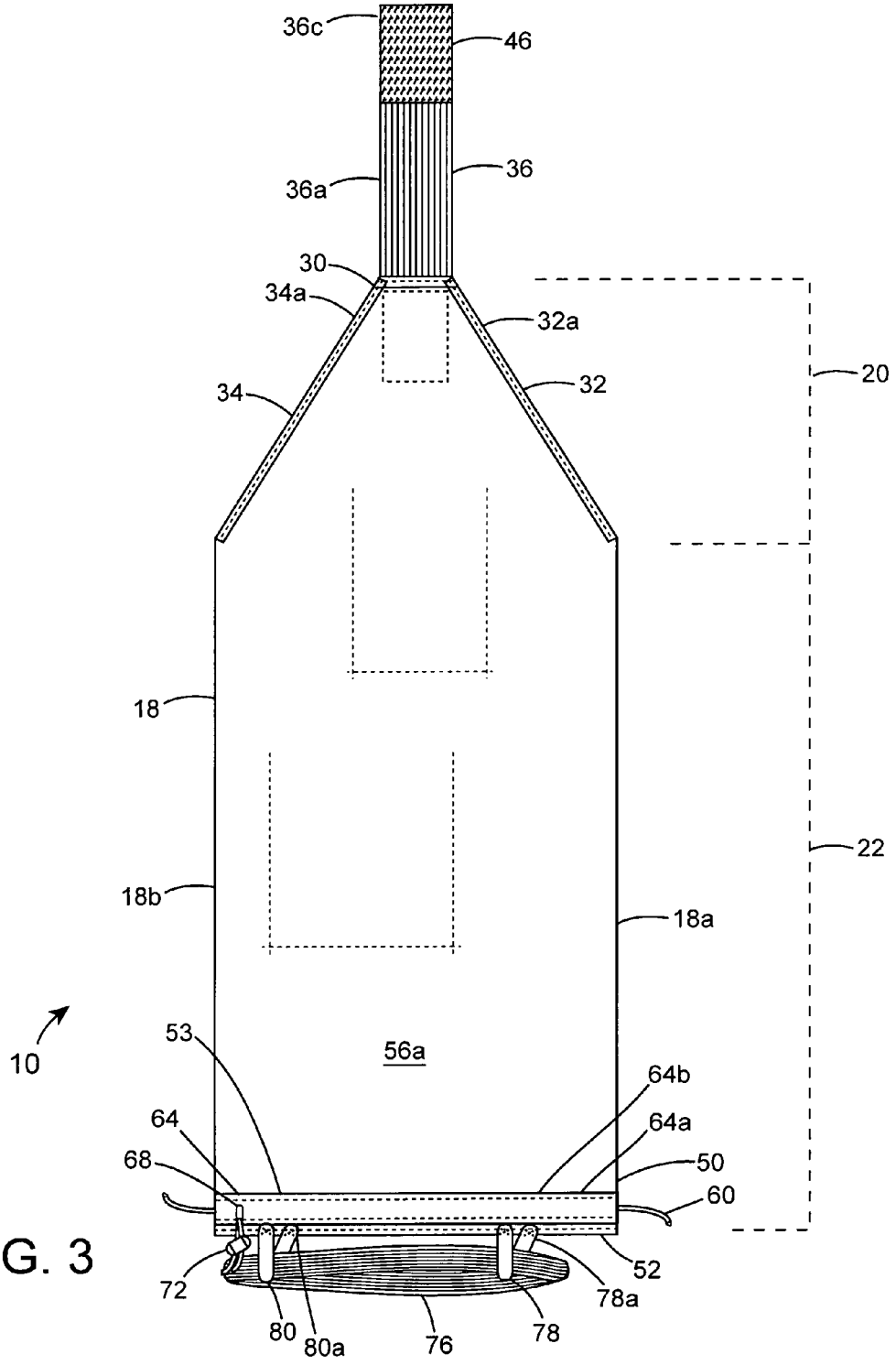
FIG. 3 is a back side view of the preferred embodiment of the present invention illustrating the geometric shape of a tubular member in an open, laid out form and comprising an elastic strap connected to an upper converging end thereof and a circumferential sleeve connected to a lower portion thereof.

Referring now to FIG. 1, there is shown generally at 10 an insect-repelling leg garment for wear on a person 12, preferentially being worn about the lower bodily region as defined to extend from one's lower torso or hip area 14 to slightly below or at the ankle region 16 of each leg. The leg garment, as generally depicted in an open, laid out form in FIGS. 2 and 3, is fabricated from a piece of fabric sheeting 18 specifically being shaped with a triangular upper portion 20 integrally connected to and situated above a rectangular portion 22. Although the leg garment 10 may be fabricated from any one of the many fabric types available today, the preferred type of fabric inherently comprises unique physical and chemical characteristics or properties that furthers and assists the physical constructs or barriers included within the present invention to repel insects and prevent them from biting the human host. In furthering its insect-repelling characteristics, the preferred fabric type comprises within in its matrix structure active ingredients or compounds of the type typically associated and known in the art to repel insects, such as that of permethrin or permitrine. The manner or methodology of application of the insect-repelling solution to the fabric may vary from manufacture to manufacture, but a method that provides for impregnating and binding the fabric with a solution of permitrine as an active ingredient and retentive compounds, such an acrylate binding agent and silicon elastomer, quintessentially serves to retain the potency of permitrine within the fabric's structural matrix for sustained, continuous protection against biting insects notwithstanding repeated efforts and attempts to wash or launder the fabric sheeting generally forming the leg garment 10. Although the art offers numerous types of fabrics comprising insect-repelling properties and characteristics that may be adaptively suited for the present invention, the preferred embodiment thereof contemplates use of fabric impregnated with a solution of permethrin, acrylate binding agent, and silicon elastomer as described above, generally of which is manufactured and commercially offered by Utexbel of Ronse, Belgium and sold under the trade name "BuzzX®." With use of this preferred fabric type, the insect-repelling compounds present therewithin can withstand or accommodate upward to 60 to 100 wash or laundered cycles yet retain potency of the inset-repelling compounds for sustained and continuous protection against biting insects. In addition to the required preferred parameters set forth above, the present invention contemplates use of a light-weighted fabric, such as nylon or tightly woven cotton, to further aid and provide comfort to the wearer.

Referring now to FIGS. 2 and 3, the rectangular portion 22 of the fabric sheeting 18 is shown to comprise first and second edges 18*a*, 18*b* selectively arranged in a partially overlapping and abutting relation and connectively joined therealong to form a tubular member 24 for receiving and accommodating therewithin one's leg, while simultaneously the triangular upper portion yields formation of a semi-conical section 26. As generally depicted in FIG. 1, the semi-conical section is preferentially configured to engage one's outer hip area upon wear of the leg garment 10, with an opposing open side 28 generally being positioned to accommodate one's inner thigh area at and near the crotch. In furthering aspects for holding the semi-conical section 26 to and about one's hip area, the leg garment comprises upper supporting means mounted to an upper converging end 30, substantially where upward ends 32*a*, 34*a* of first and second angular sides 32, 34 defining the triangular upper portion 20 of the fabric sheeting 18 converge and meet. Consequently, with this arrangement, upper supporting means is capable of rendering the first and second angular sides in a taut relationship to mitigate the appearance of buckling of the semi-conical section 26 while positioned about one's hip area. Upper supporting means in this direct application may comprise a variety of methodologies for supporting the semi-conical section to and about one's hip area, but preferably the present invention contemplates use of an elastic strap 36 having a mid-section 36*a* situated in between first and second ends 36*b*, 36*c*, with the first end being fixedly connected to the upper converging end 30 and the second end comprising fastening means in part. In this regard, the mid-section 36*a* of the elastic strap 36 is generally positioned to engage and encircle a structural feature of an article of clothing 38, such as a belt or a belt loop, typically in the manner illustrated in FIG. 1, whereas fastening means secures the elastic strap's engaging arrangement. Other possibilities for upper supporting means may include a rope, a band, a strap, or a wire each having an end fixedly connected to the upper converging end and a free end adaptively suited to engage and encircle a belt loop, a belt or other suitable structural aspects of the article of clothing. Comparatively, dastening means comprises a first fastener 40 preferably in the form of a first hook-and-loop fastener mounted to an inward face 42 of the second end 36*c* to effect corresponding connection thereof to an outward side 44 of the fabric sheeting, substantially at or near the upper converging end 30 of the triangular upper portion 20 forming the semi-conical section. By means of the connective operation of the first fastener that fulfills connection of the inward face to the outward side, the elastic strap 36 is adequately secured in placed about and around the structural feature of the article of clothing, such as one's belt, for example, to retain the semi-conical section's 26 position relatively about the hip area. Alternative forms of fastening means may comprise snaps, buttons, adhesive tape, or clips, each being particularly suited to secure the second end 36*c* to the outward side of the fabric sheeting in a manner sufficiently equal or equivalent to that of the preferred form of fastening means. In addition to the functional aspects of upper supporting means to retain the positioning of the semi-conical section 26 about one's hip, as primarily described above, upper supporting means may be utilized to facilitate compact storage of the leg garment during non-use. In this regard, the second end 36*c* of the elastic strap comprises an outward face 46 fixedly fitted with a second fastener 48 preferably in the form of a second hook-and-loop fastener that is configured to cooperatively mate with a complementary portion 40*a* of the first fastener 40 associated with connecting the inward face of the second end 36*c* of the elastic strap 36 to the outward side of the fabric sheeting. In facilitating compact storage of the leg garment 10, the leg garment is generally rolled up from a lower portion 50 of the tubular member 24 until it reaches the upper converging end 30 and upon arriving at that position, the elastic strap 36 is appropriately arranged to wrap relatively around the rolled-up configuration of the leg garment to permit the complementary portion of the first fastener to meet and engage with the second fastener.

Now by way of reference to FIG. 3, the lower portion 50, particularly about a bottom edge 52 of the rectangular portion 22, comprises an annular closing assembly 53 for closing an annular opening 54 generally formed by and present in between a circular wall section 56 of the tubular member 24 and an outer surficial portion 58 of one's leg upon wear of the leg garment 10. The annular closing assembly in this direct capacity serves to form a structural barrier to biting insects that in essence sufficiently prevents them from passing through the annular opening 54 and traversing upwardly along and about one's leg to bite and consume blood offered by the human host. Although the annular closing assembly may comprise one or more forms particularly capable of closing the annular opening, the present invention preferably utilizes an arrangement of a drawstring 60 placed or situated within a first circumferential passage 62 that is positioned on an interior side 56*a* of the circular wall section 56 of the tubular member. The first circumferential passage, as generally represented in FIG. 3, comprises a first circumferential strip 62*a* having a pair of leading edges 62*b* each being arranged in parallel fashion and sewn to the circular wall section insofar to accommodate the sliding action of the drawstring within the first circumferential passage as it is pulled or released from time to time to draw close or open the annular opening 54, respectively. As further illustrated in FIG. 3, the first circumferential passage 62 supplementally comprises a slit opening 68 extending through the first circumferential strip 62*a* to permit ends 70 of the drawstring to pass therethrough and receive a drawstring tie 72 of the type generally offered and available in the art to facilitate frictional hold of the drawstring at a predetermined length or position and temporal release thereof, typically being adjusted to coincide with the degree of openness of the annular opening 54. As an alternative configuration of the annular closing assembly, the leg garment 10 contemplates use of a foam core 74 situated within a second circumferential passage 64 that preferably exists atop the first circumferential passage 62 in a stacked arrangement, typically in the manner shown in FIG. 4. Like the first circumferential passage, the second circumferential passage is shown as comprising a second circumferential strip 64*a* having a pair of leading edges 64*b* sewn to the circular wall section of the tubular member, generally as such to substantially coincide with the location of the sewn connection of the leading edges 62*b* of the first circumferential strip 62*a*. Accordingly, by means of the stacked relationship of the first and second circumferential passages 62, 64, the alternative configuration of the annular closing assembly serves to supplement one's comfort and enhance the closure capacity of the annular opening as the drawstring 60 is tightly pulled to reduce or diminish the size of the annular opening 54 relatively existing between the second circumferential passage 64 and the outer surficial portion 58 of one's leg.

Figure 5:
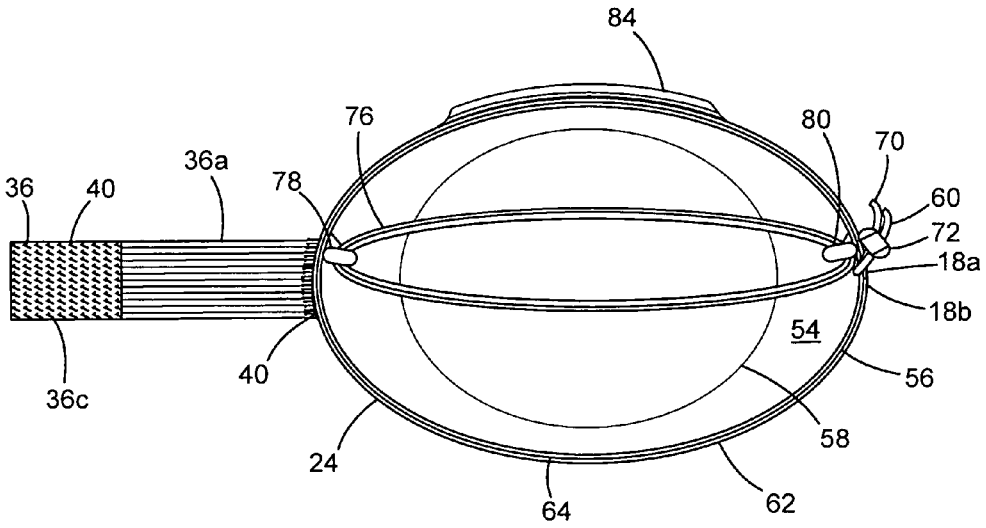
FIG. 5 is a bottom plan view of the preferred embodiment of the present invention illustrating an outer surficial portion of a person's leg received with a tubular member to form an annular opening and an elastic circular band received within first and second loops mounted to a lower portion of the tubular member.

Referring now to FIG. 5, the leg garment 10 is shown to comprise lower retaining means for retaining the lower portion 50 of the leg garment relatively about and within the vicinity of one's ankle region during moments of wear. Lower retaining means in this regard comprises an elastic circular band 76 slidably fitted within first and second loops 78, 80 each having a pair of ends 78*a*, 80*a* fixedly connected with stitching along the bottom edge 52 of the rectangular portion 22 near closure means. The first and second loops, as generally shown in FIG. 5, are substantially diametrically orientated or oppositely positioned relative to one another to evenly tension opposing sides of the leg garment about and along one's leg or ankle region as the elastic circular band 76 engages around a bottom portion 82*a* of one's footwear 82, generally forward of its heel. Preferably, the elastic circular band is fabricated as a closed-loop structure that simultaneously engages the first and second loops 78, 80 and bottom portion of one's foot or worn footwear to fulfill downward tensioning of the leg garment 10 and oppose the upward tensioning force offered by upper retaining means. Consequently, upper and lower retaining means, in a concerted manner, effectively serve to retain positioning of the leg garment relatively about the wearer notwithstanding the extent or amount of one's activity level. In lieu of the preferred arrangement of lower retaining means, as generally depicted in FIG. 1, the elastic circular band 76 may be placed within the footwear 82 itself before one's placement of his or her foot therewithin rather than being placed about the bottom portion 82*a* thereof. In this regard, the elastic circular band is kept from being prematurely worn or becoming soiled, but generally at the possible expense of one's comfort of footwear. As a second alternative configuration of lower retaining means, the elastic circular band 76 is eliminated or bypassed in its entirety whereupon a tie string with ends or a shoelace with ends 82*b* emanating from and associated with the footwear engages the first and second loops 78, 80 and pulled accordingly to draw downward to receive a tie string knot thereabout to secure the leg garment relatively within the region of one's ankle. However, the availabilty of this second alternative configuration depends primarily on the footwear's design and availability of an accommodating shoelace.

Figure 4:
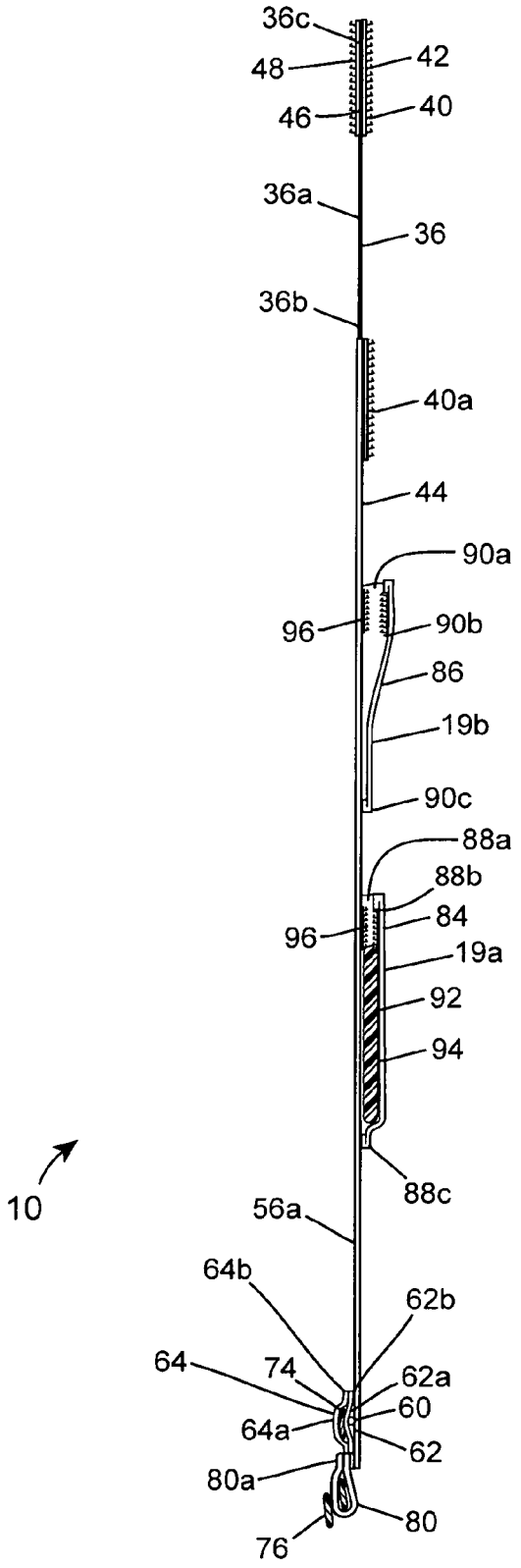
FIG. 4 is a cross sectional view of the preferred embodiment of the present invention taken along lines 4-4 in FIG. 2 illustrating a pocket and a knee guard mounted to an outward side of the fabric sheeting used to construct a tubular member and an elastic strap connected to an upper converging end of the tubular member.
Figure 6:
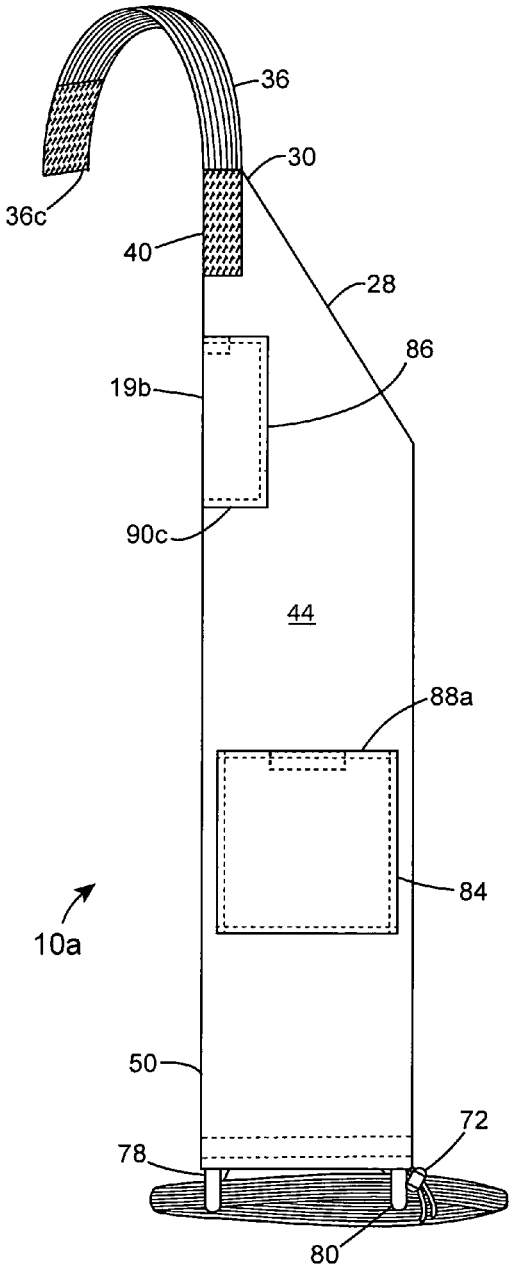
FIG. 6 is a front side view of the preferred embodiment of the present invention illustrating a tubular member for wear on a right leg of a person and comprising an elastic strap connected to an upper converging end thereof and an elastic circular band associated with a lower portion thereof.
Figure 7:
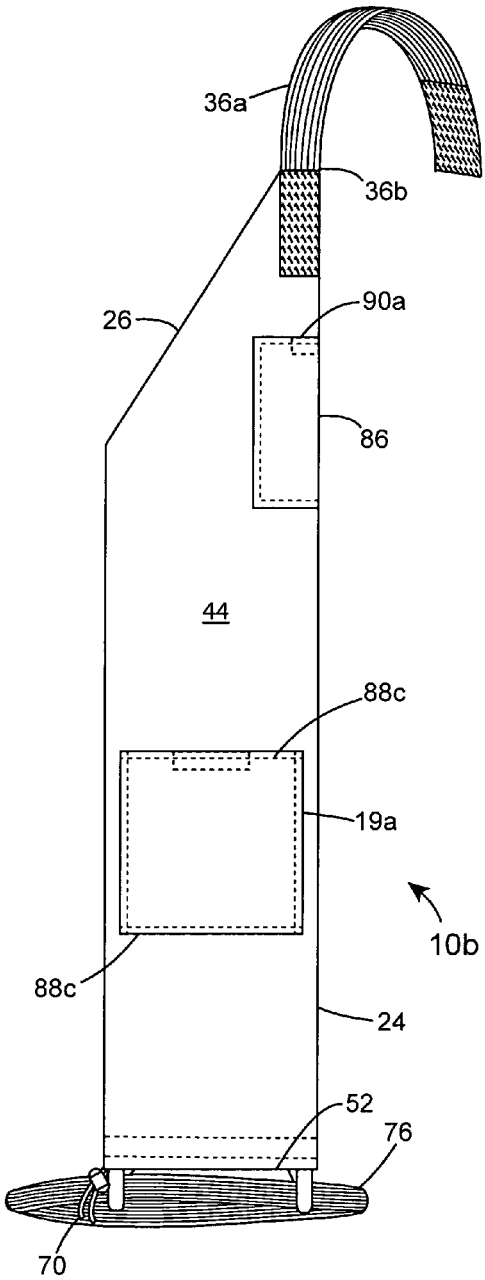
FIG. 7 is a front side view of the preferred embodiment of the present invention illustrating a tubular member for wear on a left leg of a person and comprising an elastic strap connected to an upper converging end thereof and an elastic circular band associated with a lower portion thereof.

In supplementing upper and lower retaining means, the right and left leg garments 10*a*, 10*b* are shown in FIGS. 6 and 7 to each comprise a knee guard 84 and one or more storage pockets 86 selectively placed about the outward side 44 of the fabric sheeting forming the leg garment. The knee guard and storage pocket in particular are respectively fabricated from first and second pieces of material sheeting 19*a*, 19*b* and appropriately treated with a repellant to the likes of the repellant-treated fabric sheeting 18 noted herein while each comprises a predetermined geometric shape most resembling a square or rectangular. Because the knee guard 84 is configured to fulfill protection of the knee, the knee guard is placed within or about the midsection of the leg garment insofar to coincide with one's knee upon wear of the leg garment. In contrast, the storage pocket 86 may be placed anywhere about the leg garment, but preferably within the reasonable reach of the wearer while standing erect, generally about or in vicinity of the semi-conical section 26. As generally illustrated in FIG. 2, the first and second pieces of material sheeting respectively directed to forming the knee guard and storage pocket each preferably comprise three sides 88, 90 hemmed and stitched therealong to the outward side that consequently forms an open end 88*a*, 90*a* for receiving and accepting therewithin a foam pad 92, as in the instance for the knee guard, or varied forms of personal articles for storage, as in the instance for the storage pocket. In regard to the preferred construct of the knee guard 84, the foam pad comprises a predetermined thickness and geometric shape that substantially coincides with an inner compartment 94 of the knee guard. Supplemental retention of the foam pad 92 within the inner compartment or personal articles within the storage pocket is furthered by the presence of a third fastener 96 preferably in the form of a third hook-and-loop fastener mounted to an inward side 88*b*, 90*b* of each their respective open ends to effect corresponding connection thereof to the outward side of the fabric sheeting forming the tubular member 24 and semi-conical section 26 of the leg garment, typically as illustrated in FIG. 4. To mitigate occurrences of fraying and other deleterious impacts to the knee guard or storage pocket, an edge 88*c*, 90*c* associated with each of their respective open ends is hemmed in the manner generally shown in FIGS. 6 and 7.

It is obvious that the leg garment 10 may be fabricated from one of the many fabric types generally available in the art, such as those that appeal to the tastes of the consumer in terms of design and pattern. However, with the use of any fabric type, the fabric type must possess the innate capacity to retain within its structural matrix the active insect-repelling chemical compounds for continued protection against biting insects notwithstanding repeated attempts and efforts to launder and wash the leg garment. Equally, the fabric type of choice for the leg garment should further one's comfort particularly as it is known that the leg garment 10 is generally designated for use and wear during warmer climatic conditions when biting insects are most likely present. Accordingly, it preferred that the leg garment incorporate use of advanced forms of light-weighted, breathable fabric 18 such as those that may comprise cotton, nylon or polyester.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An insect-repelling leg garment wearable on a person, the person having an outer hip area associated with a leg having an outer surficial portion, an ankle region and a foot fitted with footwear when the footwear is worn by the person, the footwear having tie string ends capable of being tied together, said leg garment comprising, in combination:

a piece of fabric sheeting impregnated with an insect-repelling solution and having a triangular upper portion, a rectangular portion and an outward side, said rectangular portion having first and second edges configurably arranged to engage and partially overlap one another and connectively joined therealong to form a tubular member and a semi-conical section;

upper supporting means attached to said semi-conical section for supporting said semi-conical section substantially about the outer hip area;

an annular closing assembly for structurally closing and sealing an annular opening formed by said tubular member and the outer surficial portion of the leg, said annular closing assembly having a first circumferential passage present about said tubular member and a second circumferential passage stackably arranged atop of said first circumferential passage, said first circumferential passage having a drawstring contained therewithin and said second circumferential passage having a foam core contained therewithin; and lower retaining means attached to said tubular member for retaining a lower portion of the tubular member relatively about the ankle region and opposing said upper supporting means to establish a taut relationship entirely about and along said tubular member and said semi-conical section.

2. A leg garment as set forth in claim 1, wherein said upper supporting means comprises an elastic strap having a mid-section situated in between first and second ends, said first end being fixedly connected to said semi-conical section, said second end having fastening means for fastening said second end to said outward side of the fabric sheeting after said mid-section of the elastic strap engages relatively around a structural feature of an article of clothing.

3. A leg garment as set forth in claim 2, wherein said second end of the elastic strap comprises an inward face and said semi-conical section comprises an upper converging end, said fastening means comprising a first fastener mounted to said inward face to effect corresponding connection thereof to said outward side of the fabric sheeting near said upper converging end and said first end of the elastic strap.

4. A leg garment as set forth in claim 1, wherein said insect-repelling solution comprises permitrine or permethrin as an active ingredient and retentive compounds to facilitate binding of the active ingredient to said fabric sheeting and retain the active ingredient's potency to repel insects therefrom notwithstanding repeated wash cycles.

5. A leg garment as set forth in claim 1, wherein said first circumferential passage comprises a first circumferential strip having a pair of leading edges sewn to said tubular member and a slit opening extending through said first circumferential strip to permit ends of the drawstring to pass therethrough and to receive a drawstring tie.

6. A leg garment as set forth in claim 5, wherein said second circumferential passage comprises a second circumferential strip having a pair of leading edges sewn to said tubular member to substantially coincide with the sewn connection of said leading edges of the first circumferential strip.

7. A leg garment as set forth in claim 1, wherein said lower retaining means comprises first and second loops diametrically mounted to said lower portion of the tubular member and an elastic circular band for simultaneously engaging said first and second loops and encircling around a portion of the foot.

8. A leg garment as set forth in claim 1, wherein said lower retaining means comprises first and second loops diametrically mounted to said lower portion of the tubular member, whereby the tie string ends of the footwear are configured to pass through and engage said first and second loops before being tied together.

9. A leg garment as set forth in claim 1, wherein said tubular member comprises a knee guard fabricated from a first piece of material sheeting having three sides stitched and hemmed to said outward side of the fabric sheeting to form an open end and an inner compartment configured with a foam pad.

10. A leg garment as set forth in claim 9, wherein said open end comprises an inward side having a third fastener fixedly attached thereto to effect corresponding connection thereof to said outward side insofar to seal close said inner compartment for supplemental retention of said foam pad.

11. A leg garment as set forth in claim 1, further comprising one or more pockets each being fabricated from a second piece of material sheeting having three sides stitched and hemmed to said outward side of the fabric sheeting to form an open end for receiving therethrough personal articles for temporary storage.

12. An insect-repelling garment wearable on a person, the person having an outer hip area associated with left and right legs each having an outer surficial portion, an ankle region and a foot fitted with footwear when the footwear is worn by the person, the footwear having tie string ends capable of being tied together, said garment comprising, in combination:

left and right leg garments each having a tubular member and a semi-conical section and being fabricated from a piece of fabric sheeting impregnated with a solution of permitrine as an active ingredient and retentive compounds, said tubular member of each of the left and right leg garments having a lower portion, said left and right leg garments each having an outward side;

left and right elastic straps each having a first end respectively connected to said semi-conical section of each of the left and right leg garments, a second end having a first fastener affixed thereto to effect corresponding connection thereof to said outward side respectively associated with each of said left and right leg garments and a mid-section situated in between said first and second ends, said mid-section of each of the left and right elastic straps being configured to engage around a structural feature of an article of clothing sufficiently capable of supporting said semi-conical section of each of the left and right leg garments substantially about the outer hip area before effecting connective operation of said first fastener respectively associated with each of the left and right elastic straps;

left and right annular closing assemblies for structurally closing and sealing an annular opening respectively formed by said tubular member of each of the left and right leg garments and the outer surficial portion of each of the left and right legs, said left and right annular closing assemblies each having a first circumferential passage respectively present about said tubular member of each of the left and right leg garments and a second circumferential passage stackably arranged atop of said first circumferential passage of each of the left and right annular closing assemblies, said first circumferential passage of each of the left and right annular closing assemblies having a drawstring contained therewithin and said second circumferential passage of each of the left and right annular closing assemblies having a foam core contained therewithin;

first and second loops diametrically mounted to said lower portion of the tubular member of each of the left and right leg garments; and left and right elastic circular bands each respectively associated with said tubular member of each of the left and right leg garments for simultaneously engaging said first and second loops of the tubular member of each of the left and right leg garments and encircling around a portion of the left foot and the right foot to retain said lower portion of the tubular member of each of the left and right leg garments relatively about the corresponding ankle region and oppose upward tensioning of said left and right elastic straps to establish a taut relationship respectively about and along each of said left and right leg garments.

13. A garment as set forth in claim 12, wherein said first circumferential passage of each of the left and right annular closing assemblies comprises a first circumferential strip sewn respectively to said tubular member of each of the left and right annular closing assemblies and a slit opening extending respectively through said first circumferential strip to permit ends of the drawstring to pass therethrough and to receive a drawstring tie.

14. A garment as set forth in claim 13, wherein said second circumferential passage of each of the left and right annular closing assemblies comprises a second circumferential strip sewn respectively to said tubular member of each of the left and right annular closing assemblies to substantially coincide with the sewn connection of said first circumferential strip respectively associated with the left and right annular closing assemblies.

15. A garment as set forth in claim 12, wherein said retentive compounds comprise an acrylate binding agent and a silicon elastomer to facilitate binding of the permitrine to said fabric sheeting and retain the permitrine's potency as the active ingredient to repel insects therefrom notwithstanding repeated wash cycles.

16. A garment as set forth in claim 12, wherein said second end of each of the left and right elastic straps comprises an outward face having a second fastener to effect corresponding connection thereof with a complementary portion of the first fastener respectively associated with each of the left and right leg garments after attaining placement of said left and right elastic straps respectively around a rolled-up configuration of each of said left and right leg garments to effect compact storage thereof.

17. A garment as set forth in claim 12, wherein said left and right leg garments each comprises a plurality of pockets and respectively left and right knee guards, said left and right knee guards and said pockets each being respectively fabricated from first and second pieces of material sheeting impregnated with a solution of permitrine and retentive compounds and having three sides stitched and hemmed to said outward side of each of the left and right leg garments to form an open end, said left and right knee guards each having an inner compartment configured with a foam pad.

18. An insect-repelling garment wearable on a person, the person having an outer hip area associated with left and right legs each having an outer surficial portion, an ankle region and a foot fitted with footwear when the footwear is worn by the person, the footwear having tie string ends capable of being tied together, said garment comprising, in combination:

left and right leg garments each having a tubular member and a semi-conical section and being fabricated from a piece of fabric sheeting impregnated with a solution of permitrine as an active ingredient and retentive compounds, said tubular member of each of the left and right leg garments having a lower portion, said left and right leg garments each having an outward side;

left and right elastic straps each having a first end respectively connected to said semi-conical section of each of the left and right leg garments, a second end having a first hook-and-loop fastener affixed thereto to effect corresponding connection thereof to said outward side respectively associated with each of said left and right leg garments and a mid-section situated in between said first and second ends, said mid-section of each of the left and right elastic straps being configured to engage around a structural feature of an article of clothing sufficiently capable of supporting said semi-conical section of each of the left and right leg garments substantially about the outer hip area before effecting connective operation of said first hook-and-loop fastener respectively associated with each of the left and right elastic straps;

left and right annular closing assemblies for structurally closing and sealing an annular opening respectively formed by said tubular member of each of the left and right leg garments and the outer surficial portion of each of the left and right legs, said left and right annular closing assemblies each having a first circumferential passage respectively present about said tubular member of each of the left and right leg garments, said first circumferential passage of each of the left and right annular closing assemblies having a drawstring contained therewithin;

first and second loops diametrically positioned and fixedly attached with stitching to said lower portion of the tubular member of each of the left and right leg garments; and left and right elastic circular bands each respectively associated with said tubular member of each of the left and right leg garments for simultaneously engaging said first and second loops of the tubular member of each of the left and right leg garments and encircling respectively around the left foot and the right foot to retain said lower portion of the tubular member of each of the left and right leg garments relatively about the corresponding ankle region and oppose upward tensioning of said left and right elastic straps to establish a taut relationship respectively about and along each of said left and right leg garments.

19. A garment as set forth in claim 18, wherein said retentive compounds comprise an acrylate binding agent and a silicon elastomer to facilitate binding of the permitrine to said fabric sheeting and retain the permitrine's potency as the active ingredient to repel insects therefrom notwithstanding repeated wash cycles.

20. A garment as set forth in claim 18, wherein said left and right leg garments each comprises a plurality of pockets, each of said pockets being fabricated from a second piece of material sheeting impregnated with a solution of permitrine and retentive compounds and having three sides stitched and hemmed to said outward side of each of the left and right leg garments to form an open end configured for receiving therethrough personal articles for temporary storage.

* * * * *